US006092237A

United States Patent [19]

Baldwin

[11] Patent Number: 6,092,237

[45] Date of Patent: Jul. 25, 2000

[54] DRIP CATCHING GLOVE CONSTRUCTION

[76] Inventor: Mark C. Baldwin, 2677 Broad St., York, Pa. 17404

[21] Appl. No.: 09/383,102

[22] Filed: Aug. 25, 1999

[51] Int. Cl.[7] ..... A41D 19/00

[52] U.S. Cl. ..... 2/161.7; 2/16; 2/60; 2/159; 2/161.6; 2/162

[58] Field of Search ..... 2/16, 60, 159, 2/158, 160, 161.6, 161.7, 161.8, 162, 167, 168, 169, 170, 311, 163, DIG. 5, 917, 910; 602/64; 604/292

[56] References Cited

U.S. PATENT DOCUMENTS

| | | | |
|---|---|---|---|
| 2,641,767 | 6/1953 | La Rosa | 2/159 |
| 3,883,897 | 5/1975 | Lefkowitz et al. | 2/161 |
| 4,399,567 | 8/1983 | Weon Joong | 2/161 R |
| 4,984,299 | 1/1991 | Halldórsdóttir | 2/16 |
| 5,020,160 | 6/1991 | Cano | 2/159 |
| 5,150,475 | 9/1992 | Hansen et al. | 2/16 |
| 5,297,296 | 3/1994 | Moretz et al. | 2/237 |
| 5,329,638 | 7/1994 | Hansen et al. | 2/16 |
| 5,682,612 | 11/1997 | Schwarz | 2/161.6 |
| 5,734,992 | 4/1998 | Ross | 2/161.7 |
| 5,823,012 | 10/1998 | Hacskaylo | 66/171 |
| 5,845,654 | 12/1998 | Johnson | 132/210 |
| 5,867,832 | 2/1999 | Liu | 2/161.7 |
| 5,924,130 | 7/1999 | Fragomeli | 2/16 |

*Primary Examiner*—John J. Calvert
*Assistant Examiner*—Katherine Moran
*Attorney, Agent, or Firm*—Henderson & Sturm LLP

[57] ABSTRACT

A drip catching glove construction 10 including a glove member 20 fabricated from a waterproof material 21 and having an elongated wrist portion 22. The wrist portion is provided with a collar unit 13 which includes a peripheral sponge member 40 and a peripheral skirt member 30 which surrounds the sponge member 40 and defines a liquid containment reservoir 35 having a throat which is at least partially obstructed by the sponge member 40. In addition, the invention also contemplates an absorbent wristlet construction 100 which includes a waterproof resilient wristband member 120 provided with an outer absorbent member 140 having a porous covering 142 that will admit and trap fluids.

5 Claims, 2 Drawing Sheets

DRIP CATCHING GLOVE CONSTRUCTION

BACKGROUND OF THE INVENTION

1. Field of the Invention

The present invention relates to the field of waterproof glove constructions in general, and in particular to a waterproof glove construction having a drip catching feature.

2. Description of Related Art

As can be seen by reference to the following U.S. Pat. Nos. 4,399,567; 4,984,299; 5,734,992; 5,682,612; and 5,867,832, the prior art is replete with myriad and diverse waterproof glove constructions.

While all of the aforementioned prior art constructions are more than adequate for the basic purpose and function for which they have been specifically designed, they are uniformly deficient with respect to their failure to provide a simple, efficient, and practical waterproof glove construction that has a built in liquid absorbing peripheral collar that cooperates with a retractable peripheral skirt to catch, absorb, and contain liquid spills that are deposited on the exterior of the gloves.

As anyone who has done any painting or other chore involving liquids that are applied by applicators in an overhead manner are all too well aware, the main problem with tasks of this kind is the dripping of liquid onto the exterior glove surface which will then trickle down the user's arms. Furthermore, even the rolling of the glove cuff will not eliminate this problem since the conventional cuffs do not have any means other than gravity to keep the collected liquid within the cuff.

As a consequence of the foregoing situation, there has existed a longstanding need for a new and improved waterproof glove construction having a unique fluid collection and retention feature that will prevent collected fluid drippings from escaping from the containment portion of the glove , and the provision of such a construction is a stated objective of the present invention.

BRIEF SUMMARY OF THE INVENTION

Briefly stated, the drip catching glove construction that forms the basis of the present invention comprises in general, a glove unit having a skirt unit and an absorbent collar unit.

As will be explained in greater detail further on in the specification, both the skirt unit and the collar unit are disposed in a concentric peripheral fashion around the wrist portion of the glove unit. The skirt unit cooperates with the glove unit to provide a peripheral containment reservoir. The absorbent collar unit is disposed at the throat of the containment reservoir.

In addition, the collar unit includes an absorbent sponge member that will not only absorb liquid that drips down the glove unit, but the sponge member will also swell as it becomes saturated with liquid to close the throat of the containment reservoir. In the supersaturated state, the sponge member will allow excess liquid to collect within the containment reservoir such that the swollen sponge member will also act as a temporary sealing gasket which will delay fluid escaping from the containment reservoir when the glove is disposed in a hands down orientation.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
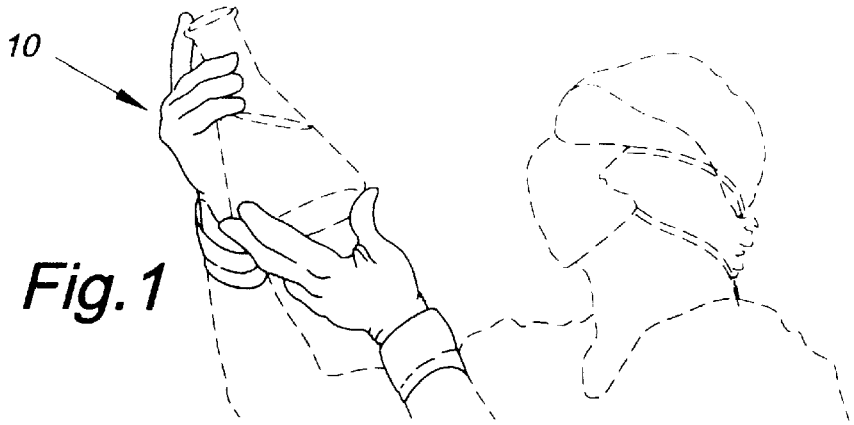
FIG. 1 is a perspective view of the drip catching glove construction in use.

As can be seen by reference to the drawings, and in particular to FIG. 1, the drip catching glove construction that forms the basis of the present invention is designated generally by the reference number 10. The glove construction 10 comprises in general, a glove unit 11, a skirt unit 12, and a collar unit 13. These units will now be described in seriatim fashion.

Figure 2:
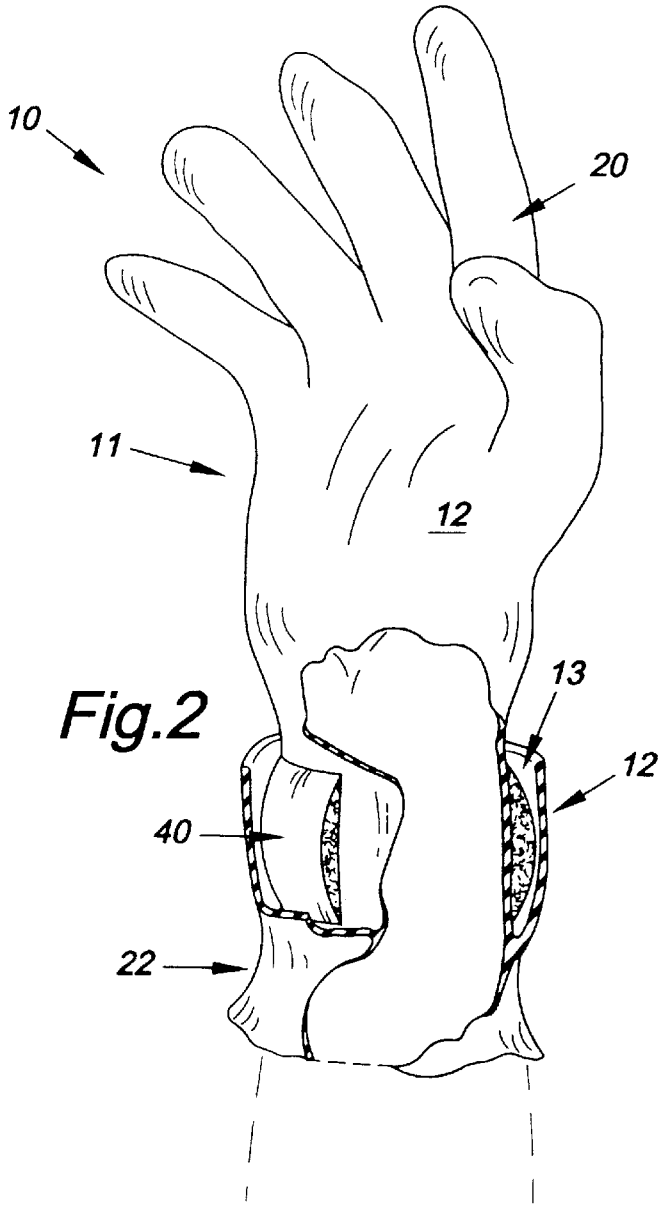
FIG. 2 is an isolated cut away perspective view of the glove construction.

As shown in FIGS. 1 and 2, the glove unit 11 comprises an elongated waterproof glove member 20 fabricated from waterproof material such as rubber or plastic and having an elongated wrist portion 22 whose purpose and function will be described presently.

Figure 3:
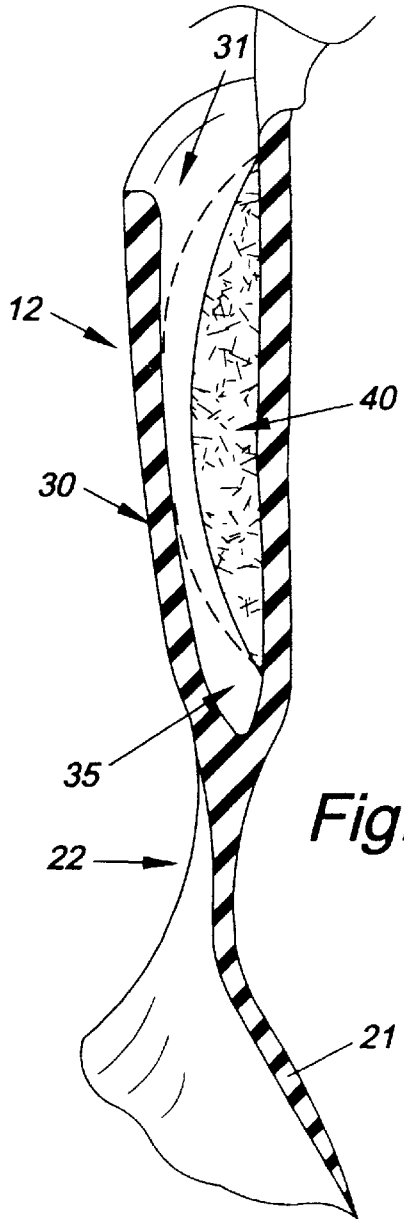
FIG. 3 is a cross sectional view taken through one side of the wrist portion of the glove construction.

Turning now to FIGS. 2 and 3, it can be seen that the skirt unit 12 comprises a peripheral skirt member 30 disposed in a surrounding relationship with the lower end of the wrist portion 22 of the glove member 20. The lower end of the skirt member 30 is hingedly affixed to and formed integrally with the wrist portion 22 of the glove member 20.

In addition, the interior wall 31 of the skirt member 30 cooperates with the exterior surface of the glove member 20 to form a peripheral containment reservoir 35 which will collect drips that travel by gravity down the exterior surface of the glove member 20.

Still referring to FIGS. 2 and 3, it can be seen that the collar unit 13 comprises an absorbent sponge member 40 which is affixed to and surrounds the upper end of the wrist portion 22 of the glove member 20.

As can also be seen by reference to FIGS. 2 and 3, the sponge member 40 has a generally arcuate cross sectional configuration which projects outwardly from the exterior surface of the glove member 20 in the vicinity of the throat of the containment reservoir 35.

As can be best appreciated by reference to FIG. 3, when the sponge member absorbs liquid it will tend to swell as indicated by the dashed lines to form a quasi-seal between the skirt member 30 and the upper end of the wrist portion 22 of the glove member 20 at the throat of the containment reservoir 35.

As mentioned previously, once the sponge member 40 becomes saturated excess liquid will be fed by gravity into the bottom of the reservoir 35 such that the entire fluid capacity of the reservoir 35 and the sponge member 40 can be effectively utilized without spillage occurring when the user moves their gloved hand back and forth in the overhead position.

Figure 4:
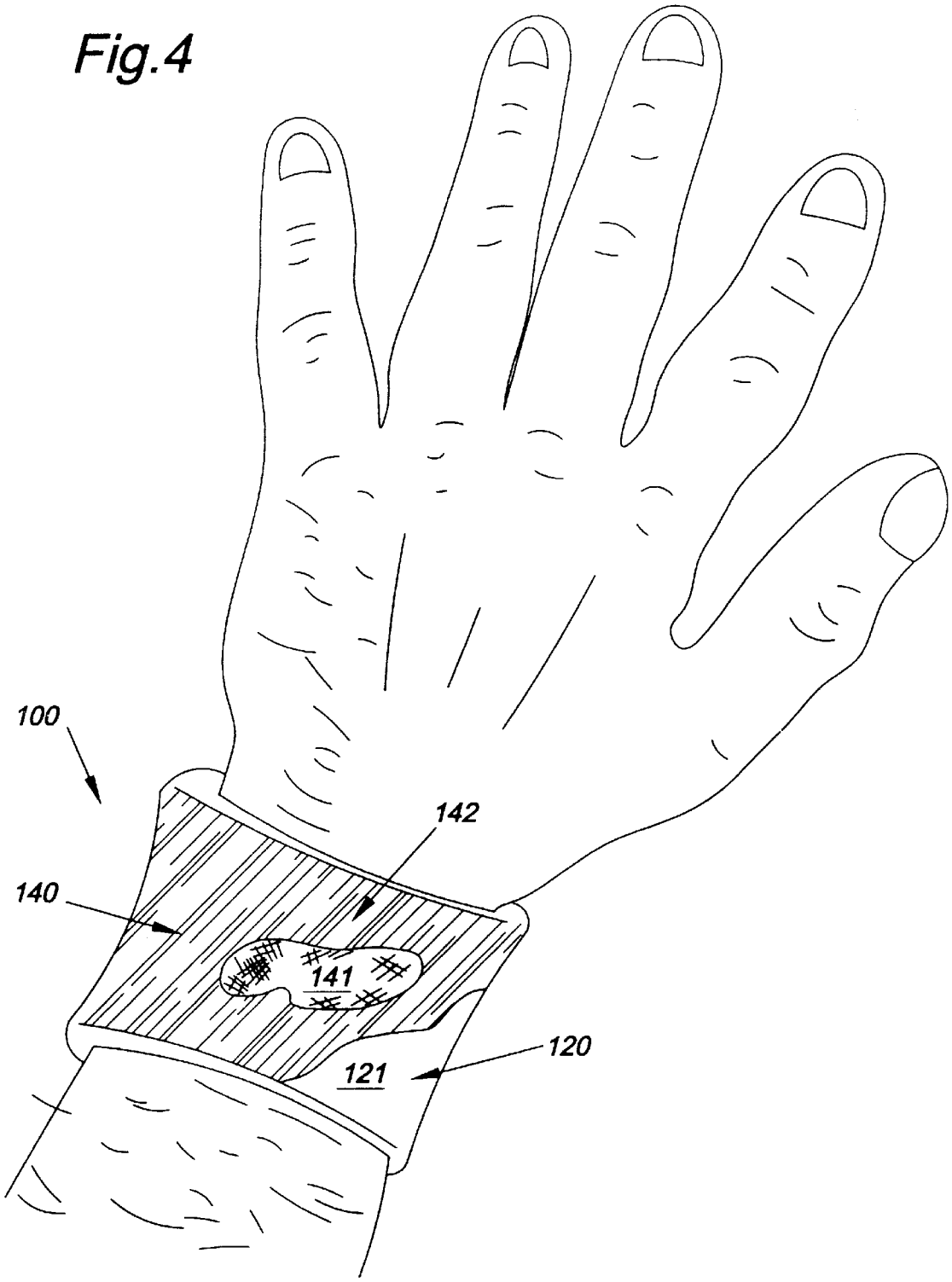
FIG. 4 is a perspective view of an alternate wristlet version of this invention.

Turning now to FIG. 4, it can be seen that the alternate version of the preferred embodiment comprises a wristlet construction designated generally as 100. The construction 100 comprises an elongated resilient wristband member 120 fabricated from waterproof material 121 such as rubber, chemical resistant plastic, or the like. The outer surface of the wristband member 120 is provided with an absorbent member 140 filled with absorbent material 141 such as cotton and/or paper fibers, or the like and provided with a porous outer cover 142 such as employed in baby diapers that will allow fluids to pass through the porous outer cover 14 and become trapped by the absorbent material 141.

This alternate version of the invention is provided primarily for auto mechanics and the like who cannot use gloves during their routine maintenance chores because the gloves are too thick and/or lack the sensitivity to allow the mechanic to grasp fittings or the like with any degree of confidence.

Despite the fact that oil, and other automotive fluids will drip down the mechanic's hands there is nevertheless an urgent need to provide this absorbent wristlet version for mechanics and the like to prevent the fluids from running down their arms as they perform certain tasks. Not only would these wristlets improve the overall efficiency of the mechanics, but they would also boost the moral of the mechanics by reducing an unnecessarily messy aspect of their job.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A drip catching waterproof glove construction comprising:

a glove unit including a glove member fabricated from a waterproof material and having a wrist portion;

a collar unit including a sponge member disposed in a surrounding relationship with the wrist portion of the glove member; and a skirt unit including a peripheral skirt member attached to the wrist portion of the glove member at a point below the sponge member wherein the skirt member includes a wall that surrounds the sponge member.

2. The glove construction as in claim 1 wherein the skirt member is formed integrally with the glove member.

3. The glove construction as in claim 1 wherein the glove member has a lower end which extends below the skirt member.

4. The glove construction as in claim 1 wherein the skirt member has an interior wall that cooperates with the exterior surface of the glove member to define a peripheral containment reservoir.

5. The glove construction as in claim 4 wherein the containment reservoir has a peripheral throat and the sponge member projects outwardly into the peripheral throat.

* * * * *